US008400058B2

(12) United States Patent
Kawasaki et al.

(10) Patent No.: US 8,400,058 B2
(45) Date of Patent: Mar. 19, 2013

(54) PLASMA DISPLAY PANEL AND METHOD OF MANUFACTURING THE SAME

(75) Inventors: Takashi Kawasaki, Miyazaki (JP); Yasuhito Yamaryo, Miyazaki (JP); Atsuo Ohtomi, Miyazaki (JP)

(73) Assignee: Hitachi, Ltd., Tokyo (JP)

( * ) Notice: Subject to any disclaimer, the term of this patent is extended or adjusted under 35 U.S.C. 154(b) by 484 days.

(21) Appl. No.: 12/394,087

(22) Filed: Feb. 27, 2009

(65) Prior Publication Data

US 2009/0256478 A1 Oct. 15, 2009

(30) Foreign Application Priority Data

Apr. 11, 2008 (JP) ..... 2008-103945

(51) Int. Cl.
*H01J 17/49* (2012.01)

(52) U.S. Cl. ..... 313/582; 313/586; 313/587

(58) Field of Classification Search ..... 313/582–587
See application file for complete search history.

(56) References Cited

U.S. PATENT DOCUMENTS

| | | | | |
|---|---|---|---|---|
| 2004/0053081 | A1* | 3/2004 | Sakurai et al. | 428/704 |
| 2004/0075388 | A1* | 4/2004 | Miyashita et al. | 313/586 |
| 2006/0261738 | A1* | 11/2006 | Ohtoh et al. | 313/586 |
| 2006/0284559 | A1* | 12/2006 | Naoi et al. | 313/586 |
| 2007/0126361 | A1 | 6/2007 | Lee | |

FOREIGN PATENT DOCUMENTS

| | | | |
|---|---|---|---|
| JP | 07-296718 | A | 11/1995 |
| JP | 08-212931 | A | 8/1996 |
| JP | 2002-190250 | A | 7/2002 |
| JP | 2004-182521 | A | 2/2004 |
| JP | 2006-127864 | A | 5/2006 |
| JP | 2006-147417 | A | 6/2006 |
| JP | 2006-244784 | A | 9/2006 |
| JP | 2007-128894 | A | 5/2007 |
| JP | 2007-254269 | A | 10/2007 |
| JP | 2008-016214 | A | 1/2008 |
| JP | 2008-021660 | A | 1/2008 |
| JP | 2008-027924 | A | 2/2008 |

OTHER PUBLICATIONS

Nishida et al., "Preparation and Properties of Magnesia Powder by Vapor Phase Oxidation Process", *Journal of the Society of Materials Science*, Japan , vol. 36, No. 410, Nov. 1987, pp. 1157-1161.

* cited by examiner

*Primary Examiner* — Anh Mai
*Assistant Examiner* — Zachary J Snyder
(74) *Attorney, Agent, or Firm* — Miles and Stockbridge P.C.

(57) ABSTRACT

A PDP to improve a discharge delay includes X and Y electrodes, a dielectric layer covering the X and Y electrodes, and a protective layer covering the dielectric layer. The protective layer includes an MgO film stacked on a surface of the dielectric layer, and a plurality of MgO crystal particles attached on the MgO film. In addition, a covering ratio of a surface of the MgO film is lower than or equal to 10%, and the plurality of MgO crystal particles are arranged so that orientations of surfaces opposing to the discharge space are aligned. Further, the plurality of MgO crystal particles have a cubic form.

6 Claims, 8 Drawing Sheets

| | D10 | D50 | D90 | DISCHARGE DELAY |
|---|---|---|---|---|
| SAMPLE 1 | 0.59 | 0.91 | 1.67 | × |
| SAMPLE 2 | 0.69 | 1.13 | 2.55 | × |
| SAMPLE 3 | 0.77 | 1.26 | 2.91 | ○ |
| SAMPLE 4 | 0.90 | 1.50 | 3.34 | ○ |
| SAMPLE 5 | 0.83 | 1.46 | 3.98 | ○ |
| SAMPLE 6 | 0.90 | 1.52 | 3.32 | ○ |
| SAMPLE 7 | 0.80 | 1.32 | 2.94 | ○ |
| SAMPLE 8 | 0.89 | 1.60 | 4.04 | ○ |
| SAMPLE 9 | 1.00 | 1.83 | 4.31 | ○ |
| SAMPLE 10 | 1.16 | 2.77 | 6.14 | ○ |

PLASMA DISPLAY PANEL AND METHOD OF MANUFACTURING THE SAME

CROSS-REFERENCE TO RELATED APPLICATION

The present application claims priority from Japanese Patent Application No. JP 2008-103945 filed on Apr. 11, 2008, the content of which is hereby incorporated by reference into this application.

TECHNICAL FIELD OF THE INVENTION

The present invention relates to a plasma display panel and a method of manufacturing the same. More particularly, the present invention relates to a technique effectively applied to improve a discharge delay of a plasma display panel.

BACKGROUND OF THE INVENTION

Plasma display panel (PDP) is a display panel which displays images by generating gas discharge in a discharge space called a cell in which a discharge gas such as rare gas to excite a phosphor by vacuum ultra violet rays generated by the gas discharge.

Currently, generally commercialized PDPs employing an AC (alternate current) driving method are surface discharge type. The surface discharge type PDP can arrange phosphors for color display away from display electrode pairs toward a thickness direction of the panel, and characteristic degradation of the phosphors due to ion bombardment (sputtering) in discharge can be accordingly reduced. Therefore, the surface discharge type PDP is suitable for elongating lifetime as compared with an opposed discharge type PDP in which display electrodes to be paired (called an X electrode and a Y electrode) are distributed to a front plate and a rear plate.

In the generally used surface discharge type PDPs, a protective film for preventing a dielectric layer from degradation due to ion bombardment in discharge is provided to a front plate. The protective film not only prevents the dielectric layer from degradation due to ion bombardment in discharge, but also has a function to grow discharge by emitting secondary electrons as ions collide against the protective film.

As the protective film, a thin film of magnesium oxide (MgO) is generally used according to its ion bombardment resistance and easiness in secondary electron emission (refer to Japanese Patent Application Laid-Open Publication No. 2006-147417 (Patent Document 1)).

SUMMARY OF THE INVENTION

<Study on Discharge Delay>

The protective film of MgO mentioned above has a high secondary electron radiation coefficient and so is effective for reducing a firing voltage. However, in recent years, there has been arising a necessity for further improving addressing speed along with demands for higher definition in PDPs. As a result, improvement of a discharge delay has been a new important issue.

More specifically, as advancing an improvement in definition (resolution) of a PDP, the number of display lines is increased. For example, the so-called full high definition standard contains 1,080 display lines. In the PDP, a predetermined frame period (field) is divided into a plurality of subfields, and a grayscale display is performed according to combinations of the numbers of cycles of sustain discharges (display discharges) made in each subfield. In addition, to form an image, an operation for selecting cells to turn on (address (write) operation) is performed per subfield. More specifically, a pulse is applied on a scanning electrode and an address electrode of a cell to be selected to generate a discharge (address discharge) so that wall charges are formed. Thereafter, an operation (sustain operation) for generating a sustain discharge (display discharge) in the selected cell by applying a driving waveform to a cell group. Hence, to perform scanning (selection of discharge/non-discharge per display line) for, for example, 1,080 lines for subfields required in a grayscale display within a predetermined frame period, it is required to shorten the address operation period (i.e., time period taken for forming wall charges by generating an address discharge by applying a voltage (pulse) to an electrode). More particularly, the more the high definition of a PDP is improved, the greater the issue regarding how to shorten a discharge delay in the address operation etc. becomes.

Herein, "discharge delay" is generally considered to be a sum of a formation delay and a statistic delay. The formation delay is a time period from a generation of initial electrons formed between electrodes to a formation of a distinct discharge, and it is taken as a substantial minimum discharge time in the case of performing multiple discharges. On the other hand, the statistic delay is a time period from a voltage application starting ionization to start of a discharge, and since variations in discharge delay occurring when discharge is performed for multiple times is largely dominated by this time period, it is generally called "statistic delay". If these discharge delays are long, an address time has to be long to prevent display errors, and it leads to adverse effects such as shortened display period relating to image formation. Therefore, the discharge delay is preferred to be short.

In a gas discharge, charged particles in a space (discharge space) are accelerated by an external electric field and collided with other gas molecules, so that the gas molecules are ionized to increase the number of ionized particles. Meanwhile, a discharge is not started unless charged particles are supplied at first, and the discharge start is delayed until charged particles are supplied. Therefore, as supplying more priming electrons (initial charged particles) to be pilot light (priming) of a discharge in the discharge space, the discharge delay is further shortened.

In Patent Document 1 mentioned above, there is suggested a technique of providing a crystal magnesium oxide layer containing crystal powder on a MgO film as one solution to shorten the discharge delay. According to Patent Document 1,by providing powder of magnesium oxide crystal which exhibits cathode luminescence emission having a peak within 200 to 300 nm (particularly, near 235 nm), electrons can be trapped for a long period of time in an energy level corresponding to the peak wavelength, and the electrons are extracted as initial electrons necessary for starting discharge (firing), so that the discharge delay is reduced. Note that, in Patent Document 1, it is described that the powder is classified to make a frequency distribution larger for MgO crystals having a grain size larger or equal to a predetermined size to obtain powder of MgO crystal which exhibits cathode luminescence emission having a peak at a predetermined wavelength.

<Study on Technique for Arranging a Plurality of MgO Crystal Powders on Surface of MgO Film>

Meanwhile, as the inventors of the present invention have studied on the configuration described in Patent Document 1,it has been found out that it is difficult to uniform a distribution of characteristics in a PDP or characteristics of respective PDPs in the configuration.

That is, it is necessary to increase the amount of arranged MgO crystal to shorten the discharge delay uniformly in a plane of a PDP, and the surface of the MgO film is thus covered by the MgO crystal. However, in this case, a surface area of an area of the MgO crystal exposed to the discharge space is increased compared to the case of not forming the MgO crystal. MgO has a property prone to absorb impure substance such as $CO_2$ and $H_2O$, and thus a phosphor (particularly, a phosphor having a green emission property) is degraded due to impure substances increased as the surface area is increased to weaken the green emission, so that a chromatic non-uniformity to increase redness in display color (so-called red non-uniformity in a screen) become notable.

<Study on Technique for Reducing Arrangement Amount of MgO Crystal>

Accordingly, as the inventors of the present invention have studied on a technique for improving exposed area of MgO film by reducing the amount of MgO crystals to attach, it has been found out as a result that a new problem arising in a case of, for example, simply reducing the amount of arranging MgO crystals described in above-mentioned Patent Document 1.

That is, as for the discharge delay, the supplying amount of priming electrons becomes small when the arrangement amount of MgO crystals is simply reduced, so that the discharge delay cannot be made shorter eventually. Note that, Patent Document 1 describes that the amount of powder of MgO crystals can be made small by increasing a percentage of a grain size distribution (frequency distribution) of crystals having large grain sizes in MgO crystals by classification. However, simply performing a classification cannot remove fine (minute) MgO crystal particles attached on respective MgO crystals as shown in FIG. 6 or FIG. 7 of Patent Document 1. In addition, part of MgO crystals (particularly, vertex of cube) may be damaged by shock and so forth in a classification. Further, damaged fragment may be attached on the MgO film after arranging MgO crystals. Therefore, the discharge delay cannot be shortened because orientations of planes facing the discharge space of MgO crystal cannot be aligned and it becomes impossible to sufficiently supply the priming electrons.

The present invention has been made with regard to the above-mentioned problems, and an object thereof is to provide a technique capable of improving a discharge delay of a PDP.

The above and other objects and novel characteristics of the present invention will be apparent from the description of the present specification and the accompanying drawings.

As a result of a study and experiments made by the inventors of the present invention to solve the above problems, it has been revealed that the red chromatic non-uniformity in the screen mentioned above or an increase of discharge voltage can be suppressed by making a covering ratio of the MgO film to lower than or equal to 10%. In addition, it has been experimentally fount out that the discharge delay can be improved even when the amount of attaching MgO crystal particles by aligning orientations of planes of the MgO crystal particles opposing to the discharge space.

The typical ones of the inventions disclosed in the present application will be briefly described as follows.

That is, a plasma display panel according to an embodiment of the present invention includes a pair of plate structures opposing to each other interposing a discharge space formed with filling a discharge gas. One of the pair of plate structures has a plurality of display electrode pairs arranged on a substrate, a dielectric layer covering the plurality of display electrodes, and a protective layer covering the dielectric layer. Here, the protective layer includes an MgO film stacked on a surface of the dielectric layer, and a plurality of MgO crystal particles attached on the MgO film. In addition, the covering ratio on a surface of the MgO film is lower than or equal to 10%. Further, a shape of an MgO crystal single particle forming the MgO crystal particles is cubic.

The effects obtained by typical aspects of the present invention will be briefly described below.

That is, a discharge delay of a PDP can be improved.

BRIEF DESCRIPTIONS OF THE DRAWINGS

DESCRIPTIONS OF THE PREFERRED EMBODIMENTS

Before describing the present invention in detail, terminology in the present application is as follows. "MgO crystal single particle" means a primary particle (single particle) of a crystal formed by MgO. Hence, the "MgO crystal single particle" does not include a secondary particle such as an aggregate in which a plurality of single particles are aggregated and a lump. On the other hand, "MgO crystal particle" is used as a generic name including the aggregate in which a plurality of single particles are aggregated and the lump in addition to the MgO crystal single particle.

"Grain size granularity" shows a percentage of total of particles having a size smaller than or equal to a specific grain size. That is, accumulation 50% value means that particles having a grain size smaller than or equal to the specific grain size occupy 50% of total. For example, to explain with reference to (B) in FIG. 8, the accumulation 50% value is 1.27 μm, and particles smaller or equal to 1.27 μm are occupying 50% of total.

In the embodiments described below, the invention will be described in a plurality of sections or embodiments when required as a matter of convenience. However, these sections or embodiments are not irrelevant to each other unless otherwise stated, and the one relates to the entire or a part of the other as a modification example, details, or a supplementary explanation thereof.

Also, components having the same function are denoted by the same reference symbols throughout the drawings for describing the embodiments, and the repetitive description thereof will be omitted. In the following, embodiments of the present invention will be described in detail with reference to the drawings.

<1. Basic Structure of PDP>

Figure 1:
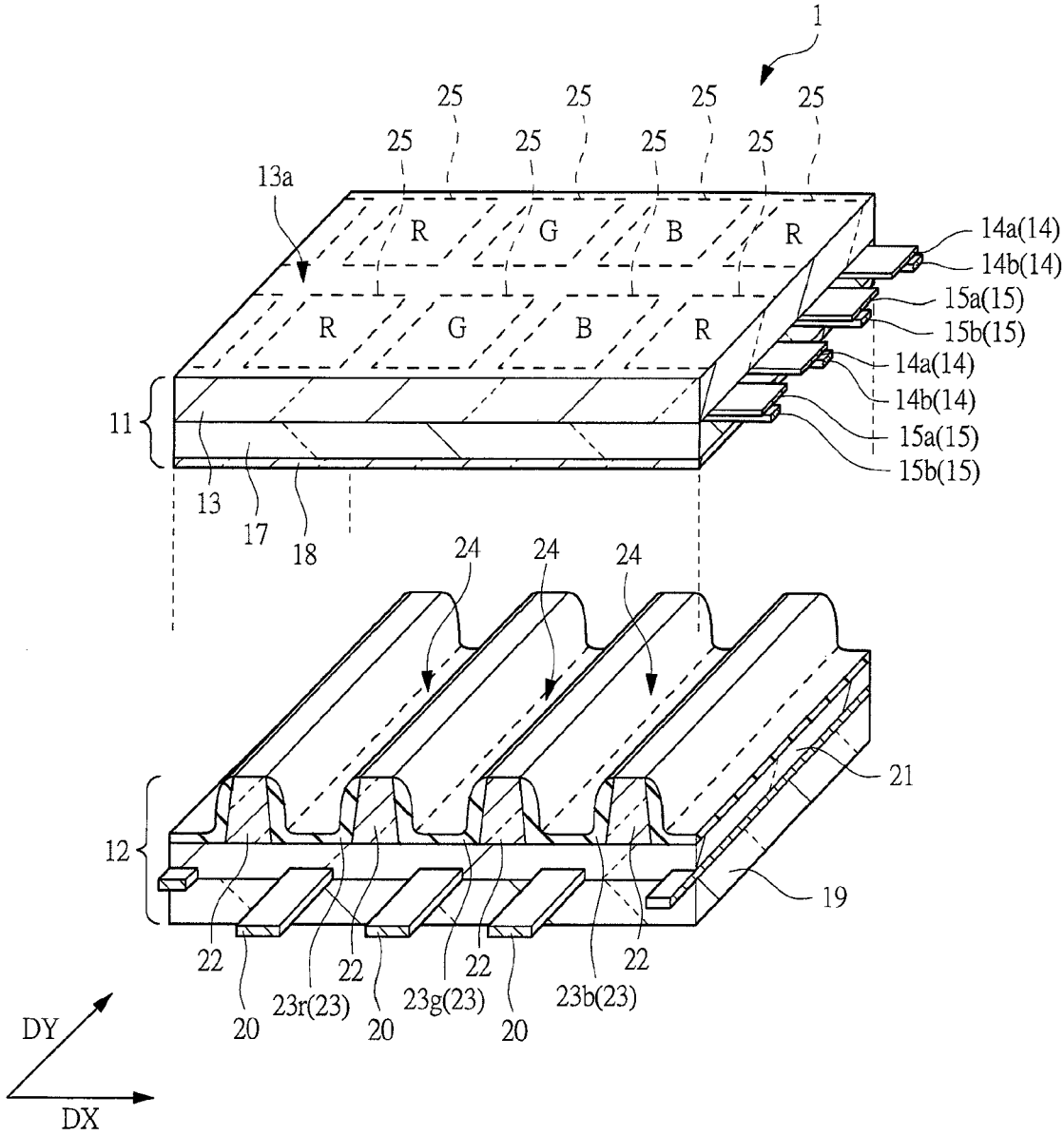
FIG. 1 is an enlarged assembly perspective view of main parts showing main parts of a PDP of an embodiment of the present invention.
Figure 2:
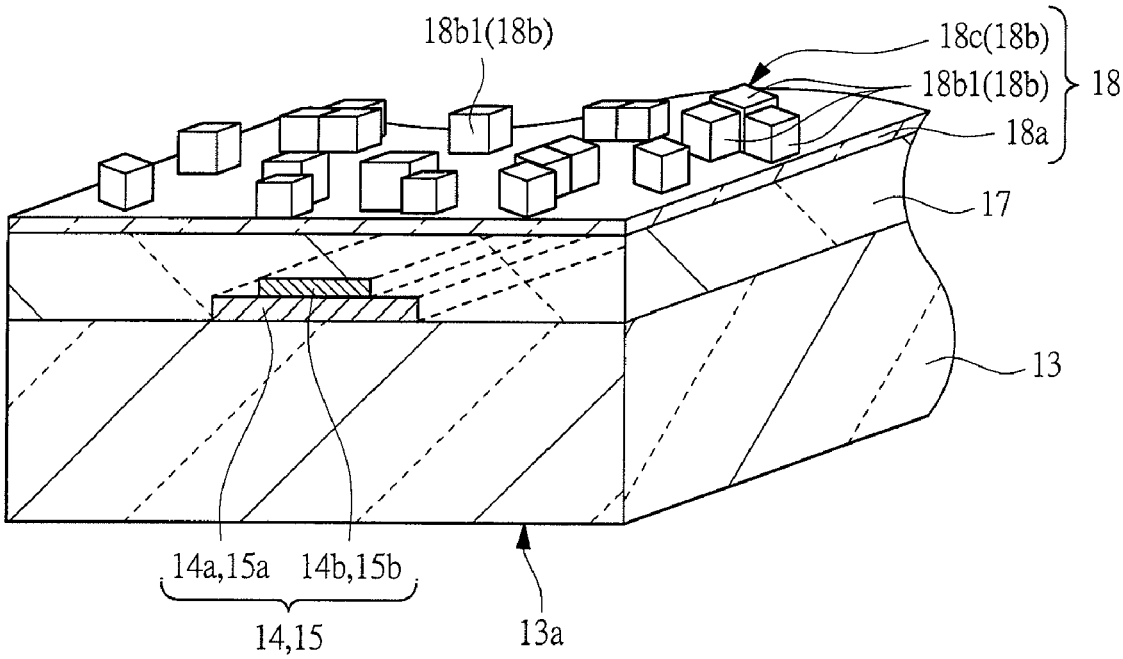
FIG. 2 is an enlarged perspective view of main parts showing a surface condition of a protective layer shown by vertically reversing front and rear plate structures shown in FIG. 1.

First, an example of a structure of a PDP of a present embodiment will be described with exemplifying a three-electrode surface-charge type PDP of an AC-driving type for color display with reference to FIG. 1 and FIG. 2. FIG. 1 is an enlarged assembly perspective view of main parts showing main parts of a PDP of an embodiment of the present invention, and FIG. 2 is an enlarged perspective view of main parts showing a surface condition of a protective layer shown by vertically reversing front and rear plate structures shown in FIG. 1.

In FIG. 1, a PDP 1 includes a front plate structure 11 and a rear plate structure 12 which are a pair of plate structures opposing to each other interposing a discharge space 24 formed with filling a discharge gas.

The front plate structure 11 has X electrodes 14 and Y electrodes 15 which are a plurality of display electrode pairs arranged on a front plate 13 (first plate), a dielectric layer 17 covering the display electrode pair, and a protective layer 18 covering the dielectric layer. In addition, the protective layer 18 is, as shown in FIG. 2, formed of an MgO (magnesium oxide) film 18*a* stacked on a surface of the dielectric layer 17, and a plurality of cubic MgO crystal grains 18*b* attached on the MgO film 18*a*.

The front plate structure 11 and the rear plate structure 12 are overlapped in a state they are arranged opposite to each other, and the discharge space 24 is provided between the front plate structure 11 and the rear plate structure 12. That is, the front plate structure 11 and the rear plate structure 12 are arranged opposite to each other interposing the discharge space 24.

The front plate structure 11 has a first surface 13*a* to be a display surface of the PDP 1, and the front plate 13 that is, for example, a glass plate. The X electrode (display electrode) 14 and the Y electrode (display electrode, scan electrode) 15 which are display electrodes are plurally formed respectively on a surface (inner surface) opposite to the first surface 13*a* of the front plate 13.

The X electrode 14 and the Y electrode 15 configure one display electrode pair for making a sustain discharge (display discharge), and they are alternately arranged to extend having a strip-like shape along a row direction DX. The pair of the X electrode 14 and the Y electrode 15 configure a display line in the row direction DX in the PDP 1. Note that, while two pairs of the X electrode 14 and the Y electrode 15 are shown in FIG. 1 being enlarged, the PDP 1 has the plurality of X electrodes 14 and Y electrodes 15 corresponding to the number of the display lines.

The X electrode 14 and the Y electrode 15 are generally configured by an X transparent electrode 14*a* and a Y transparent electrode 15*a* formed of a transparent electrode material such as ITO (Indium Tin Oxide) and $SnO_2$, and an X bus electrode 14*b* and a Y bus electrode 15*b* formed of, for example, Ag, Au, Al, Cu, Cr, or a layered body of these elements (for example, a layered body of Cr/Cu/Cr).

The X transparent electrode 14*a* and the Y transparent electrode 15*a* mainly contribute to a sustain discharge, and they have a higher optical transmittance than the X bus electrode 14*b* and the Y bus electrode 15*b* so that emission of phosphors can be observed from the front plate 13 side. On the other hand, since the X bus electrode 14*b* and the Y bus electrode 15*b* flow currents for driving with a low resistance, a metal material having a resistance lower than that of the X transparent electrode 14*a* and the Y transparent electrode 15*a* is used.

A process of forming the display electrode pair (X electrode 14 and Y electrode 15) to one surface (surface positioned on a side opposite to first surface 13*a*) of the front plate (first plate) 13 is carried out as follows. More specifically, a thick-film formation technique such as screen printing is used for the transparent electrode materials, Ag and Au, and a thin-film formation technique such as vapor deposition and sputtering and an etching technique are used for other metals, so that the electrodes can be formed with a predetermined number, thickness, width, and spacing (interval).

While the X transparent electrode 14*a* and the Y transparent electrode 15*a* are shaped in a strip-like shape to extend in FIG. 1, the electrode structure of the X transparent electrode 14*a* and the Y transparent electrode 15*a* is not limited to this. For example, for stabilization of sustain discharge and improvement of discharge efficiency, it may be a structure in which a protruded portion is formed from a position where the X transparent electrode 14*a* and Y transparent electrode 15*a* and the X bus electrode 14*b* and Y bus electrode 15*b* are overlapped toward the opposing electrode so that the minimum distance (called discharge gap) between the pair of electrodes become closer corresponding to a cell. Further, the configuration of the protruded portion may be used as many kinds of alternative embodiments such as a straight shape, T shape, or ladder shape and the like. In addition, the electrode structure of the X electrode 14 and the Y electrode 15 are not limited to the shape shown in FIG. 1. For example, it may be a structure called ALIS (Alternate Lightning of Surface Method) in which these display electrode pairs are arranged at even intervals and all the spaces between the neighboring X electrodes 14 and Y electrodes 15 become display lines.

These electrode group (X electrodes, Y electrodes 15) are covered by the dielectric layer 17 mainly formed of a glass material such as $SiO_2$. A process of forming the dielectric layer 17 to cover the display electrode pair is carried out as follows. More specifically, the dielectric layer 17 is formed by applying a frit paste containing a low melting point glass powder as its main component on the front plate 13 by screen printing and bake the same. Other than that, the dielectric layer 17 may be formed by a method of adhering a sheet-like dielectric sheet so-called green sheet and baking the same. Alternatively, the dielectric layer 17 may be formed by depositing a $SiO_2$ film by plasma CVD.

On the inner side of the dielectric layer 17, the protective layer 18 for protecting the dielectric layer 17 from shocks due to ion collision generated by discharged for display (mainly, sustain discharge) is formed. Therefore, the protective layer 18 is formed to cover the surface of the dielectric layer 17. A detailed structure and functions of the protective layer 18 and a detailed process of forming the protective layer 18 on the surface of the dielectric layer 17 will be described later.

On the other hand, the rear plate structure 12 includes a rear plate 19 that is, for example, a glass plate. A plurality of address electrodes 20 are formed on a surface (inner surface) of the rear plate 19 opposing to the front plate structure 11. Each address electrode 20 is formed to extend along a column direction DY intersecting (substantially orthogonal to) the direction in which the X electrode 14 and Y electrode 15 extend. In addition, respective address electrodes 20 are arranged having a predetermined arrangement interval between each other to be substantially parallel to each other.

As a material for forming the address electrode 20, similar to the X bus electrode 14*b* and Y bus electrode 15*b*, for example, Ag, Au, Al, Cu, Cr, or a layered body of these elements (for example, Cr/Cu/Cr) can be used. In addition, by utilizing a thick-film formation technique or a thin-film formation technique such as vapor deposition and sputtering, and an etching technique according to a material to be used for the address electrode 20, the address electrode 20 can be formed with a predetermined number, thickness, width, and spacing (interval).

The address electrode 20 and the Y electrode 15 formed to the front plate structure 11 configure an electrode pair for making an address discharge that is a discharge for selection on/off of cells 25. That is, the Y electrode 15 has a function as an electrode for sustain discharge and a function as an electrode (scan electrode) for address discharge together.

The address electrode 20 is covered by a dielectric layer 21. The dielectric layer 21 can be formed by using the same material and the same method as those of the dielectric layer 17 on the front plate 13. A plurality of barrier ribs 22 extending in a thickness direction of the rear plate structure 12 are formed on the dielectric layer 21. The barrier rib 22 is formed to extend in a line-like shape along the column direction DY in which the address electrode 20 extends. The front plate structure 11 and the rear plate structure 12 are fixed in a state where the surface on which the protective layer 18 is formed and the surface on which the barrier ribs 22 are formed are opposing to each other. A position of the barrier rib 22 on the plane is arranged between the neighboring address electrodes 20. By arranging the barrier rib 22 between the neighboring address electrodes 20, the discharge space 24 which sections the surface of the dielectric layer 21 in the column direction DY corresponding to the position of the respective address electrodes 20. Note that, to the shape of the barrier rib 22 other than the line-like shape shown in FIG. 1, various modification examples such as a meander shape, grid-shape, or ladder-shape can be applied.

A process of forming the barrier rib 22 can be carried out by a sandblast method, a photo-etching method, and the like. For example, in the sandblast method, a frit paste formed of a low melting point glass frit, a binder resin, a solvent, etc. is applied on the dielectric layer 21 and dried, then cutting particles are sprayed onto the frit paste layer with providing a cutting mask having openings of a barrier rib pattern on the frit paste, so that the frit paste layer exposed from the openings of the mask are cut, and further baking the same. In addition, in the photo-etching method, a photo-sensitive resin is used for the binder resin instead of cutting by cutting particles, and the barrier rib 22 is formed by an exposure and development using a mask followed by baking.

Phosphors 23*r*, 23*g*, and 23*b* generating visible light of respective colors of red (R), green (G), and blue (B) by being excited by vacuum ultraviolet rays are formed at respective predetermined positions on an upper surface of the dielectric layer 21 on the address electrode 20 and side surfaces of the barrier ribs 22. A process of forming the phosphors 23*r*, 23*g*, and 23*b* in areas sectioned by the barrier ribs 22 is carried out as follows. First, phosphor pastes containing phosphor powders having respective emission properties, a binder resin, and a solvent are prepared respectively. The phosphor paste is applied in the discharge space sectioned by the barrier ribs by screen printing or a method using a dispenser, and repeating this step for each color, and then the phosphors 23*r*, 23*g*, and 23*b* are formed by baking.

In addition, the phosphors 23*r*, 23*g*, and 23*b* can be formed by a photolithography technique using a phosphor layer material (so-called green sheet) in a sheet-like shape containing a phosphor powder, a photo-sensitive material, and a binder resin. In this case, each phosphor 23 of each color can be formed between corresponding barrier ribs 22 by adhering the sheet of a predetermined color on the whole display region on the plate and subject it to exposure and development, and repeating the step for each color.

Further, gas called discharge gas such as a rare gas is filled in each of the discharge spaces 24 at a predetermined pressure. As the discharge gas, a gas mixture such as Xe—Ne having a partial pressure ratio of Xe arranged to be several percents to several tens of percents can be used.

The PDP 1 can be obtained by assembling the surface of the front plate 13 on which the display electrode pairs are formed and the rear plate with arranging them oppose to each other interposing the discharge spaces 24. In the assembly process, a position-aligning step of the front plate 13 and the rear plate 19, a sealing step of sealing outer periphery portion between respective plates (front plate 13 and rear plate 19) by using, for example, a low melting point glass material called sealing frit, a step of exhausting gas remaining in internal space of the PDP 1 and filling the discharge gas to the space, and so forth.

In the PDP 1, one cell 25 is configured to correspond to an intersection of the one pair of X electrode 14 and Y electrode 15 and the address electrode 20. In other words, the cell 25 is formed at every intersection of the display electrode pair (pair of the X electrode 14 and Y electrode 15) and the address electrode 20. A plane area of the cell 25 is defined by the arrangement interval of the pair of X electrode 14 and Y electrode 15, and the arrangement interval of the barrier ribs 22. In addition, either of the phosphor 23*r* for red, phosphor 23*g* for green, or phosphor 23*b* for blue is formed in each cell 25.

A pixel is configured by a set of respective cells 25 of R, G, and B. More specifically, respective phosphors 23*r*, 23*g*, and 23*b* are light emitting elements of the PDP 1, and they emit visible lights of respective colors of red (R), green (G), and blue (B) by being excited by ultra violet rays having a predetermined wavelength generated by the sustain discharge.

Note that, while an example of forming the address electrode 20 to the rear plate structure 12 has been described in FIG. 1, the address electrode 20 can be formed on the front plate structure 11. In this case, the dielectric layer 17 is made to have a multilayer structure, and the display electrode pair is covered by a first layer of the dielectric layer and the address electrode 20 can be formed between the first layer and a second layer of the dielectric layer.

<2. Detailed Structure and Function of Protective Layer>

Figure 3:
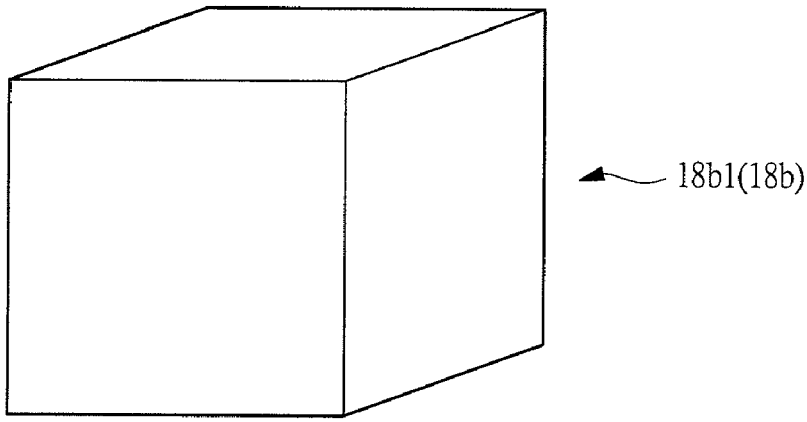
FIG. 3 is a diagram showing an example of an MgO crystal particle shown in FIG. 2 and is a perspective view of an MgO crystal single particle.
Figure 4:
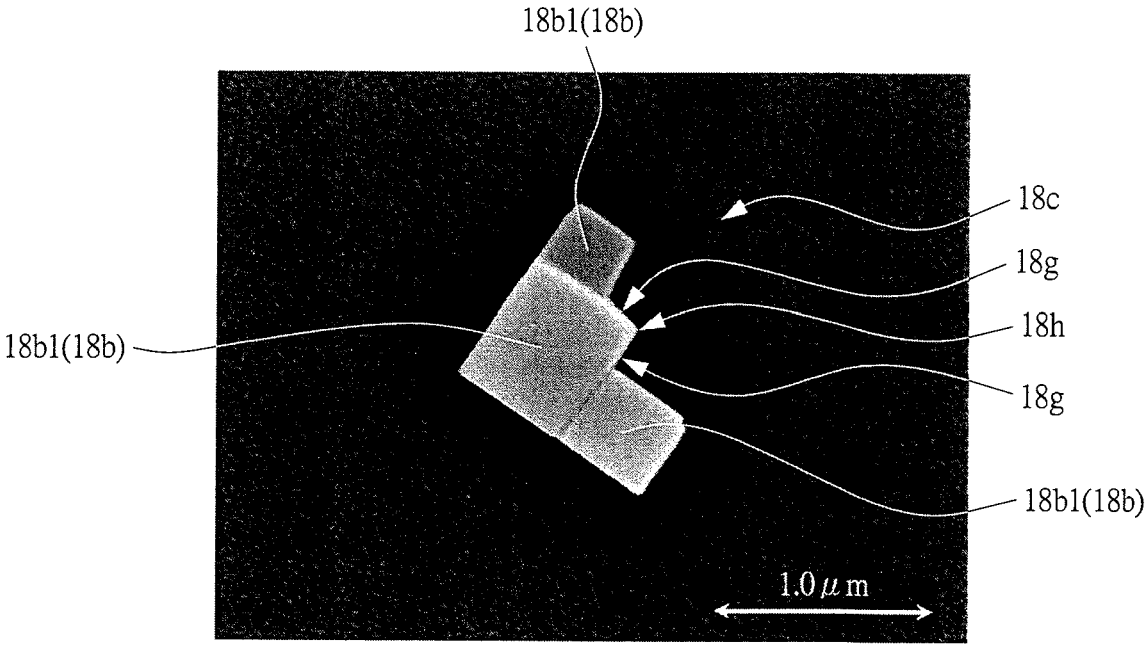
FIG. 4 is a diagram showing an example of an MgO crystal particle shown in FIG. 2 and is an explanatory diagram showing an aggregate made by aggregating side surfaces of three MgO crystal single particles.
Figure 5:
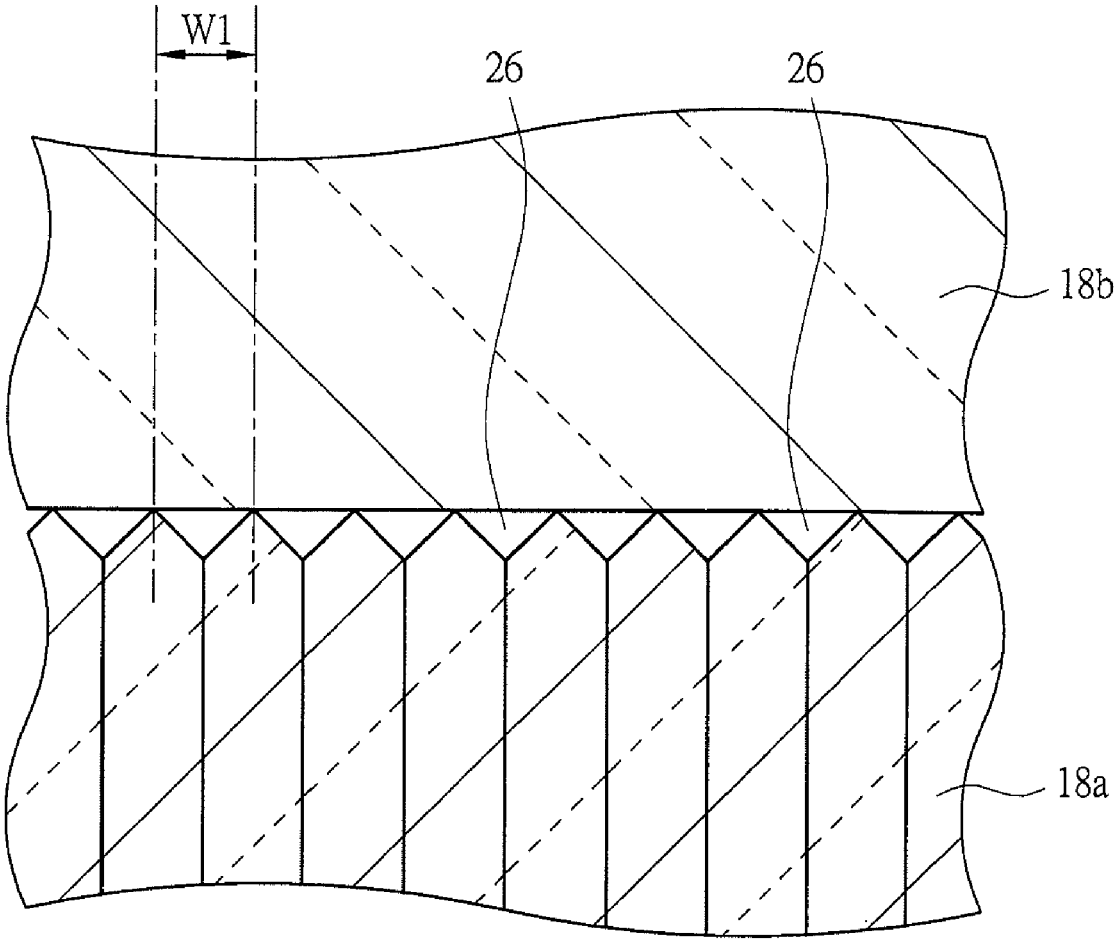
FIG. 5 is an enlarged cross-sectional view showing a microscopic relation of the MgO film and the MgO crystal particle shown in FIG. 2 to FIG. 5.
Figure 6:
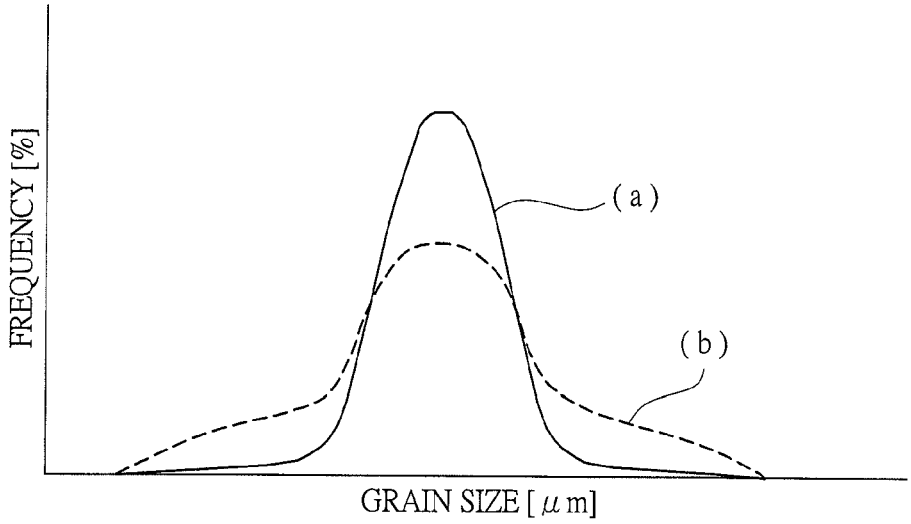
FIG. 6 is an explanatory diagram for describing a grain size distribution model of MgO crystal particles.
Figure 7:
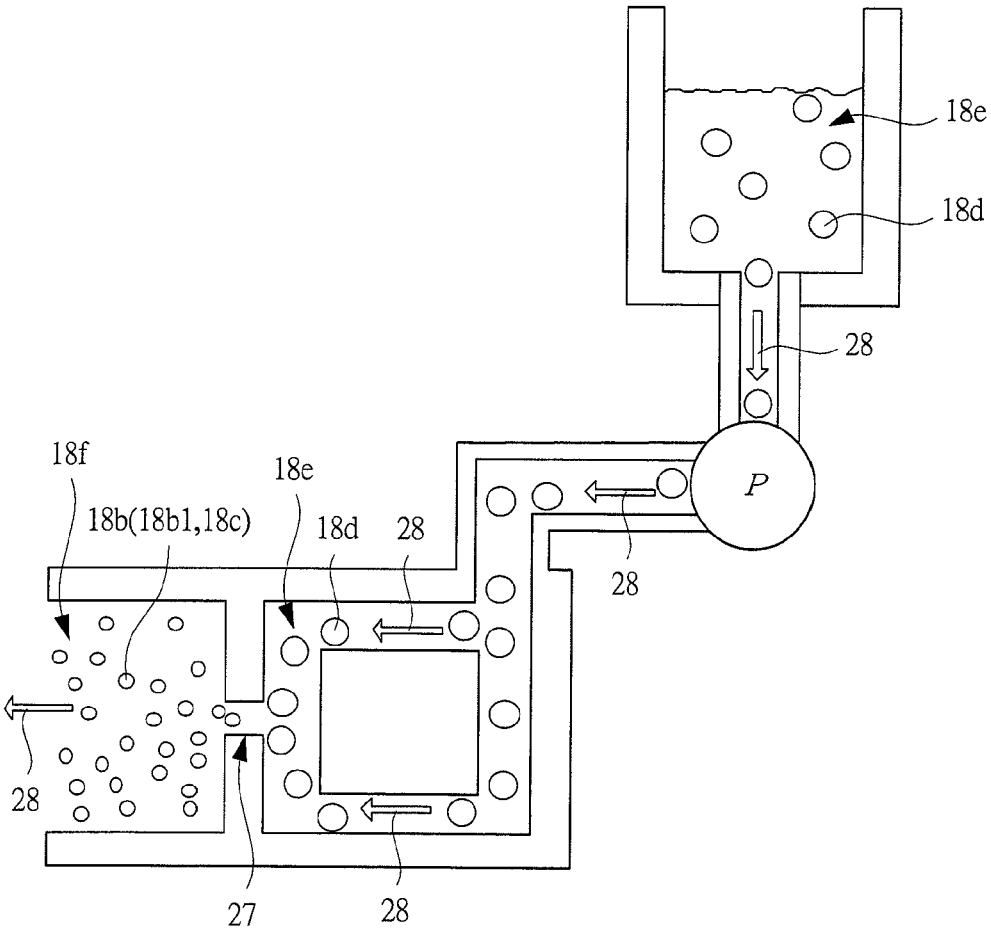
FIG. 7 is an explanatory diagram for describing one example of an aspect of a grinding method in a grinding process for preparing the MgO crystal particles shown in FIG. 2 to FIG. 5.
Figures 8, 9:
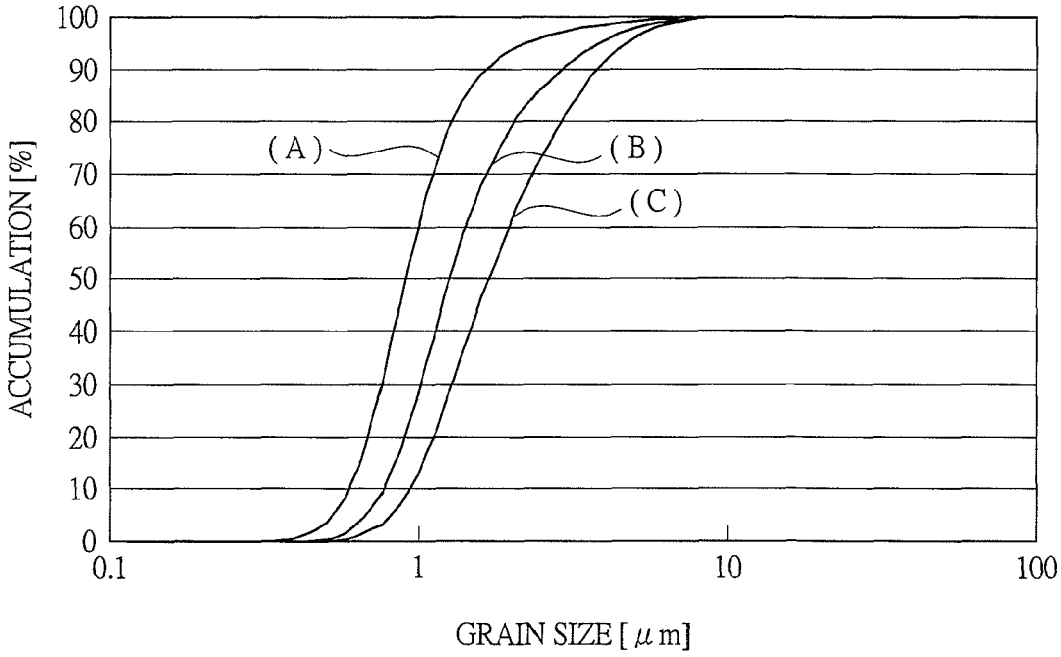
FIG. 8 is an explanatory diagram showing a accumulated grain size distribution of the MgO crystal particles for each grinding method in a grinding process for preparing the MgO crystal grains shown in FIG. 2 to FIG. 5.
FIG. 9 is an explanatory diagram showing a result of an effect verification experiment of an embodiment of the present invention.
Figure 10:
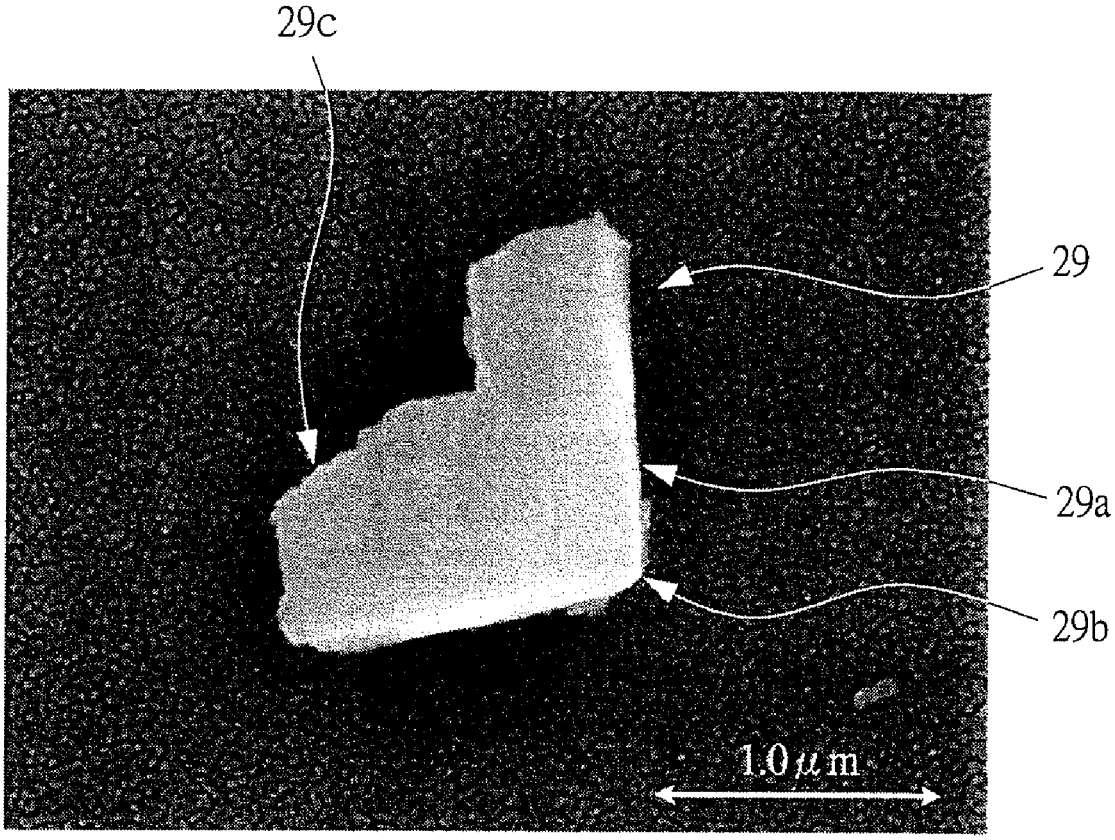
FIG. 10 is an explanatory diagram showing an example of an MgO crystal particle of a comparative example to the embodiment of the present invention.
Figure 11:
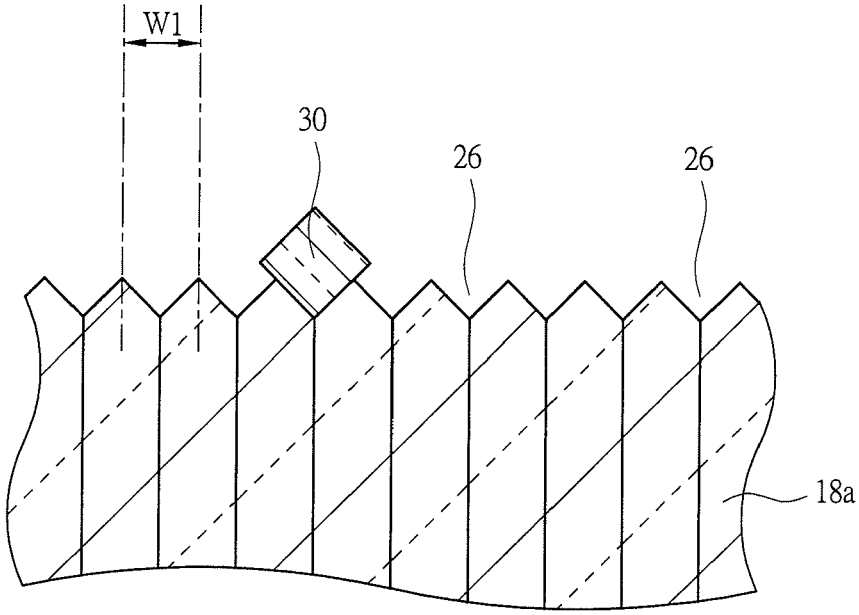
FIG. 11 is an enlarged cross-sectional view showing a microscopic relation of an MgO film and the MgO crystal particle of the comparative example to the embodiment of the present invention.
Figure 12:
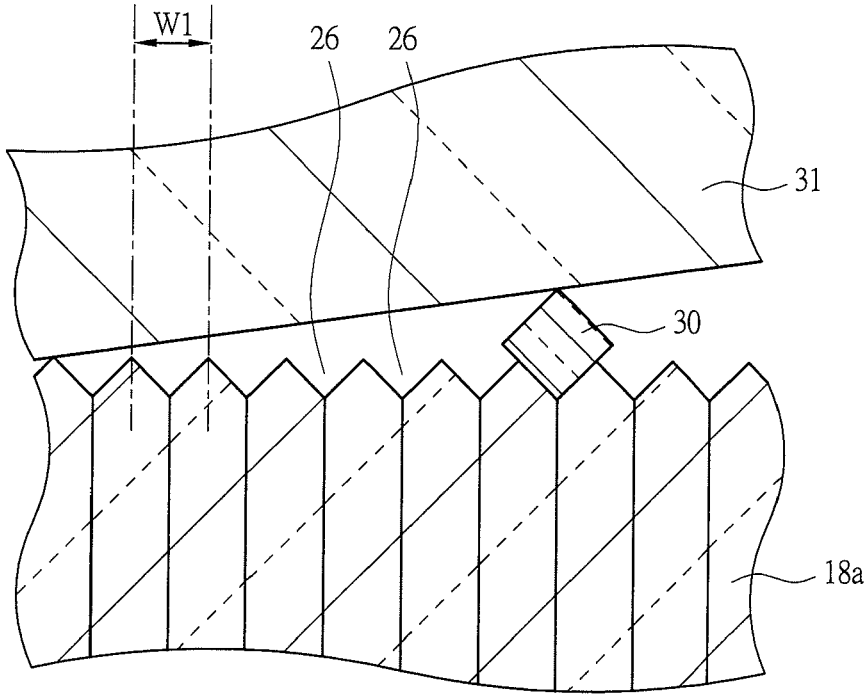
FIG. 12 is an enlarged cross-sectional view showing a microscopic relation of an MgO film and an MgO crystal particle of another comparative example to the embodiment of the present invention.

Next, a detailed structure and functions of the protective layer 18 shown in FIG. 1 and FIG. 2 will be described with reference to FIG. 1 to FIG. 12. FIG. 3 and FIG. 4 are diagrams showing examples of an MgO crystal single particle shown in FIG. 2, where FIG. 3 is a perspective view showing the MgO crystal single particle, and FIG. 4 is an explanatory diagram showing an aggregate in which side surfaces of the three MgO crystal single particles are tightly adhered. In addition, FIG. 5 is an enlarged cross-sectional view showing a microscopic relation of the MgO film and the MgO crystal particle shown in FIG. 2. FIG. 6 is an explanatory diagram for describing a grain side distribution model of the MgO crystal particles. FIG. 7 is an explanatory diagram for describing an aspect of a particularly preferable grinding method in a grinding process for preparing the MgO crystal particles shown in FIG. 2 to FIG. 5. FIG. 8 is an explanatory diagram showing accumulate grain side distributions of the MgO crystal particles for respective grinding methods in the grinding process for preparing the MgO crystal particles shown in FIG. 2 to FIG. 5. FIG. 10 is an explanatory diagram showing an example of an MgO crystal particle of a comparative example to the present embodiment. Moreover, FIG. 11 and FIG. 12 are enlarged cross-sectional views showing microscopic relations of an MgO film and the MgO crystal particle of comparative examples to the present embodiment.

In FIG. 2, the protective layer 18 is formed of an MgO film 18*a* stacked on the surface of the dielectric layer 17 and a plurality of MgO crystal particles 18*b* attached on the MgO film 18*s*.

<2-1. MgO Film>

The MgO film 18*a* has an orientation plane of (111) plane on a plane opposing to the discharge space 24 (cf. FIG. 1). The protective layer 18 is required to have, as well as a function of preventing the dielectric layer 17 from being degraded by shocks due to ions in discharges, a function of advancing growth and duration of discharges by emitting secondary electrons. Therefore, while MgO having a high secondary electron emission coefficient is used for the protective layer 18, a higher secondary electron emission coefficient can be obtained when making the opposing plane to the discharge space 24 to be (111) plane than the case of (100) plane. Since the PDP 1 can improve the secondary electron emission coefficient by making the opposing plane to the discharge space 24 of the MgO film 18*a* to have (111) plane, a discharge voltage can be reduced. That is, the PDP 1 can reduce a discharge voltage. Note that, while the orientation of the surface of the MgO film 18*a* is mainly (111) plane, it is not that an aspect of the surface of the MgO film 18*a* including orientation planes other than (111) plane is excluded.

In addition, while the MgO film 18*a* is formed of MgO as its main component, an additive (for example, CaO) for improving a sputtering resistance and the secondary electron emission coefficient can be added. In this case, a sputtering resistance and the secondary electron emission coefficient of the protective layer 18 can be further improved.

A process of forming the MgO film 18*a* can be carried out by a thin-film process such as electron beam evaporation and sputtering known in the present field.

<2-2. MgO Crystal Particle>

<2-2-1. About Discharge Delay>

Next, while the MgO crystal particle 18*a* may be made of only MgO, it may contain a small amount of other components (for example, residue of a flux) to the extent not to affect the crystal structure.

The MgO crystal particle 18*b* has a function of applying priming electrons (initial charged particles) to be a pilot light (priming) of a discharge when making the address discharge or the display discharge to the discharge space 24. That is, by attaching the plurality of MgO crystal particles 18*b* onto the MgO film 18*a*, the priming electrons in the discharge space 24 can be increased. When the priming electrons in the discharge space 24 are increased, a time period from applying a voltage for discharge to starting a discharge can be shortened. For example, in the case of address discharge, a time period from applying a voltage across the address electrode 20 and the Y electrode 15 shown in FIG. 1 to starting an address discharge can be shortened, so that the discharge delay in the address discharge can be shortened.

An arrangement amount of the MgO crystal particles 18*b*, that is, an attached amount of the MgO crystal particles 18*b* on the surface of the MgO film 18*a*, is large, so that a supplied amount of the priming electrons inside the discharge space 24 is increased.

<2-2-2. Problems and Solutions in Attaching MgO Crystal Particles>

Meanwhile, according to the study made by the inventors of the present invention, an abnormality occurs in display colors of the PDP 1 when excessively increasing the attached amount of the MgO crystal particles 18*b*. That is, when the MgO crystal particles 18*b* are attached, a surface area of the MgO crystal particles 18*b* exposed to the discharge space 24 becomes large as compared with the case of not attaching the MgO crystal particles 18*b*. MgO has a property prone to absorb impure substances such as $CO_2$ and $H_2O$, and emission of green is weakened as the phosphor (particularly, the phosphor having an emission property of green) is degraded due to impure substances increased along with an increase of the surface area, so that chromatic non-uniformity (so-called red chromatic non-uniformity in the screen) which increases redness in the display colors may occur. While the phenomenon is effectively small to be negligible when the attached amount of the MgO crystal particles 18*b* is small, the phenomenon become greater as the attached amount is increased. As a result of a study made by the inventors experimentally on the critical point, the phenomenon becomes particularly apparent when a covering ratio of the MgO film 18*a* exceeds 10%.

In addition, it has been found out that the discharge voltage is raised when the attached amount of the MgO crystal particles 18*b* is made excessively large. This is expected that the emitted amount of secondary electrons is lowered by covering the surface of the MgO film 18*a* by the MgO crystal particles 18*b*.

Accordingly, in the present embodiment, the attached amount of the MgO crystal particles 18*b* is reduced to make the covering ratio of the MgO film 18*a* lower than or equal to 10%. Here, the "covering ratio" means a percentage of an area of the MgO crystal particles 18*b* to an area of the MgO film 18*a* being a base when the MgO crystal particles 18*b* are observed in a direction orthogonal to the surface of the MgO film 18*a* on which the MgO crystal particles 18*b* are spread out. In the present embodiment, covering ratios are measured at every point of a plurality of measurement points with respect to a viewing range of 0.6 mm×0.6 mm square. For example, 10 measurement points were measured linearly at a 10 mm interval. The viewing range of 0.6 mm×0.6 mm square is set by a particularly preferable range in view of a relation between a accumulate grain size distribution of the MgO crystal particles and a measurement accuracy of the covering ratio. In addition, the number of measurement points and the measurement intervals are not particularly limited, but it is preferred to measure at least 10 points or more to improve accuracy.

All of the viewing ranges mentioned above in the PDP 1 of the present invention have a covering ratio of 10% or lower. In addition, all of the cells 25 provided in the PDP 1 have a covering ratio of 10% or lower. Consequently, the PDP 1 of the present embodiment has the MgO crystal particles decentrally arranged substantially uniformly.

In this manner, it has been experimentally confirmed that the abnormality (red chromatic non-uniformity) in the display colors of the PDP 1 can be suppressed by reducing the attached amount of the MgO crystal particles 18*b* to make the covering ratio of all of the cells 25 provided in the PDP 1 to be 10% or lower (details will be described later).

In addition, it has been confirmed that the rising of discharge voltage can be suppressed as compared with the case where the MgO crystal particles 18*b* are not attached. This is expected that the emission amount of the secondary electrons from the MgO film 18*a* can be ensured by making the covering ratio to be 10% or lower.

<2-2-3. New Problems and Solutions by Reducing Attached Amount –1>

Meanwhile, since the attached amount of the MgO crystal particles 18*b* is small in the present invention, the priming electrons cannot be sufficiently supplied when simply reducing the attached amount of the MgO crystal particles 18*b*, so that the discharge delay cannot be shortened as the result. However, as a result of the study made by the present inventors, it has been revealed that the discharge delay can be shortened even when the attached amount of the MgO crystal particles 18*b* is reduced by arranging the surfaces of the respective MgO crystal particles 18*b* opposing to the discharge space 24 to have orientations aligned by (100) plane. Here, "orientations are aligned" means that normal directions of crystal planes of the respective MgO crystal particles 18*b* are same to each other, and the MgO crystal particles 18*b* may be rotated about the normal line as long as the directions are same. In addition, "orientations of the surfaces of the respective MgO crystal particles 18*b* opposing to the discharge space 24 are aligned by (100) plane" means that a surface opposing to the discharge space 24 among surfaces which each of the MgO crystal particles 18*b* has, that is, surfaces positioned on the opposite side of surfaces opposing to the MgO film 18*a* have orientations aligned by (100) plane.

Whether the orientations of the plurality of MgO crystal particles 18*b* are aligned or not (i.e., a degree of uniformity in orientation) can be determined based on a ratio of a signal intensity of (200) plane and that of (111) plane in X-ray diffraction (XRD: C-ray Diffract meter). (200) plane is equivalent to (100) plane, and the signal of (200) plane is strong when the orientations of the plurality of MgO crystal particles 18*b* are aligned, and is very weak when the orientations of the plurality of MgO crystal particles 18*b* are not aligned. On the other hand, a signal of (111) plane is mainly from the MgO film 18*a*, and it almost does not depend on whether the orientations of the plurality of MgO crystal particles 18*b* are aligned or not. Therefore, a value of {(signal intensity of (200) plane)/(signal intensity of (111) plane)} serves as an index indicating whether the orientations of the surfaces opposing to the discharge space 24 of the plurality of MgO crystal particles 18*b* are aligned or not. More specifically, an X-ray diffraction signal intensity measurement on (200) plane per lam thickness of the MgO film is carried out and an evaluation is made regarding a value standardized according to a signal intensity ratio of (111) plane and (200) plane and a value of X-ray diffraction signal intensity of (111) plane. When the standardized value of (200) plane is larger than or same with the value of (111) plane, the discharge delay can be shortened. Note that, the standardization means that, in consideration of the signal intensity ratio in an actual measurement becomes 11.6/100 when an existence ratio of (111) plane and (200) plane is 1/1,a signal intensity in an actual measurement of (200) plane is multiplied by 0.116 as the basis for (111) plane.

First, an MgO crystal single particle 18*b*1 of the present embodiment is has a cubic form as shown in FIG. 3. In addition, the MgO crystal single particle 18*b*1 is a cubical crystal surrounded by (100) crystal planes and all the crystal planes are equivalent physically and in chemical property. Therefore, each surface of the cubic MgO crystal single particle 18*b*1 is (100) plane. In addition, one surface of the MgO crystal single particle 18*b*1 in an opposed contact with a surface of the MgO crystal film 18*a*. By making one surface of the cubic MgO crystal single particle 18*b*1 in an opposed contact with a surface of the MgO crystal film 18*a*, a normal direction of a surface on the opposite side can be aligned uniformly. In other words, orientations of surfaces opposing to the discharge space 24 of the plurality of MgO crystal particles 18*b* can be respectively aligned by (100) plane. Further, while the single particle of the each MgO crystal single particle 18*b*1 is in a cubic form, for example, an aggregate 18*c* in which side surfaces of a plurality of (three in FIG. 4) cubic MgO crystal single particles 18*b*1 are tightly attached to be aggregated is contained. In this case, while one surface of the aggregate 18*c* is to be in an opposed contact with a surface of the MgO film 18*a*, since each of the MgO crystal single particles 18*b*1 forming the aggregate is cubical, orientations of opposite surfaces (i.e., surfaces opposing to the discharge space 24) are aligned by (100) plane. In this manner, by aligning orientations of surfaces opposing to the discharge space 24 of the MgO crystal particles 18*b*, it has been experimentally revealed that the discharge delay can be shortened even in the case of reducing the attached amount of the MgO crystal particles 18*b* (covering ratio of the MgO film 18*a* is made to be 10% or lower). Details will be described later. Note that, while the state of including the aggregate 18*c* is shown in FIG. 2, it may be a case where the aggregate 18*c* is not included and all of particles attached on the MgO film 18*a* are the MgO crystal single particles 18*b*1.

In addition, by making the MgO crystal single particles 18*b*1 in a cubic form, the supplying amount of the priming electrons can be further increased. In the following, a reason of the increase will be explained with reference to FIG. 4 and FIG. 10 showing a comparative example. Note that, FIG. 4 and FIG. 10 show pictures taken by a scanning electron microscope (SEM) of the MgO crystal particles 18*b* (aggregate 18*c*) and an MgO crystal particle 29, respectively.

In FIG. 4, each the MgO crystal single particles 18*b*1 has a cubic form, and has a vertex portion 18*h* at which a substantially linear side portion 18*g* and three side portions 18*g* forming outer edges of each cubic are gathering. On the other hand, the MgO crystal particle 29 shown in FIG. 10 has an indeterminate form, sometimes having a substantially linear side portion 29*a* and a vertex portion 29*b* but most of the outer edges of the MgO crystal particle 29 have rough irregularities like a side portion 29*c*.

Here, regarding the supplying amount of priming electrons for the MgO crystal particles 18*b* and 29, more priming electrons are supplied from the side portions 18*g* and 29*a* formed more substantially-linear than respective surfaces which the MgO crystal particles 18*b* and 29 have. In addition, the vertex portion 18*h* has further larger supplying amount of priming electrons than the side portion 18*g*. On the other hand, side portions with rough irregularities like the side portion 29*c* of the MgO crystal particle 29 shown in FIG. 10 give a significantly lower supplying amount of priming electrons compared to the side portions 18*a* and 29*a*. More specifically, in the present embodiment, a lot of the side portion 18*g* or the vertex portion 18*h* giving particularly large supplying amount of priming electrons are ensured by making each of the MgO crystal single particles 18*b*1 to be cubic form, so that the supplying amount of priming electrons can be increased. Consequently, the discharge delay can be shortened even when the attached amount of the MgO crystal grains 18*b* is reduced (covering ratio of the MgO film 18*a* is made to be 10% or lower).

In addition, by making one surface of the cubic which the MgO crystal single particle 18*b*1 has in an opposed contact with a surface of the MgO film 18*a*, the contact of the surface of the MgO film 18*a* and the MgO crystal particle 18*b* becomes a stable surface contact, so that the problems of partial characteristics change due to exfoliation and scattering of the MgO crystal particles 18*b* can be suppressed.

Next, regarding a grain size of each of the MgO crystal particles 18*b*, the grain size is preferred to be the following size. A surface of the MgO film 18*a* formed by, for example, electron beam evaporation which serves as a base of the MgO crystal particles 18*b* has irregularities of a columnar crystal structure microscopically having a head-vertex portion such as shown in FIG. 5, and there is a minute spacing 26 between the head-vertexes of the columnar crystals. The head-vertex spacing W1 of the columnar crystal is, for example, about 0.05 μm. Therefore, when the grain size is smaller than two times the size of the head-vertex spacing W1 of the columnar crystal (smaller than 0.1 μm) like an MgO crystal particle 30 shown in FIG. 11 that is a comparative example to the present embodiment, the MgO crystal particle 30 may be trapped in the spacing 26 between the head-vertexes, so that the MgO crystal particle cannot be in an opposed contact with the MgO film 18*a*. In this case, since the MgO crystal particle 30 will not be in an opposed contact with the MgO film 18*a* even when it has a cubic form, its orientation of a surface opposing to the discharge space 24 will not be (100) plane, so that the orientations are not aligned. In addition, as shown in FIG. 12, even when an MgO crystal particle 31 having a grain size larger than or equal to two times the size of the head-vertex spacing W1 of the columnar crystal is provided, as long as the MgO crystal particle 30 having a grain size smaller than two times the size of the head-vertex spacing W1 (0.1 μm) is included, the MgO crystal particle 30 trapped between the spacing 26 causes to block the opposed contact of the MgO crystal particle 31 and the MgO film 18*a*, so that the orientations cannot be aligned.

On the other hand, the MgO crystal particles 18*b* include no or a few particles having a size smaller than two times the size of the head-vertex spacing W1 (0.1 μm). Therefore, as shown in FIG. 5, the surface of the MgO film 18*a* serving as the base can be regarded to be substantially flat, and that is preferable to align orientations. Note that, to align orientations, an aspect in which the particle having a size smaller than two times the size of the head-vertex spacing W1 (0.1 μm) is not included at all is more preferred, but since the discharge delay can be shortened as long as the value of (200) plane standardized after performing an X-ray diffraction is larger than or same with the value of (111) plane, the discharge delay can be improved even when particles having a size smaller than two times the size of the head-vertex spacing W1 (0.1 μm) are included as long as the value of (200) plane is within the range.

As the present inventors have done experiments on the preferred grain size of the MgO crystal particle 18*b* in view of the above-described point, it has been revealed that the preferred grain size of the MgO crystal particle 18*b* can be expressed by an accumulate grain size distribution. More specifically, it has been revealed that the orientations of the respective MgO crystal particles 18*b* are easily aligned when an accumulation 10% value in the accumulation grain size distribution of the plurality of MgO crystal particles 18*b* is made to be 0.77 μm or larger, so that the discharge delay can be improved. The accumulation grain size distribution of the MgO crystal particles 18*b* can be obtained by using a grain size distribution meter of laser diffractometry. The grain size distribution meter of laser diffractometry can measure grain sizes of each spherical particle with taking the shape of each of the MgO crystal particles 18*b* (the aggregate 18*c* is taken as one particle when the aggregate 18*c* is contained) as spherical.

When the MgO crystal particle 18*b* attached on the MgO film 18*a* is a single particle not including the aggregate 18*c*, the accumulation 10% value of the MgO crystal particle 18*b* is particularly preferred to be larger than or equal to 0.77 μm to align orientations, but the grain size of the MgO crystal particle 18*b* forming the aggregate 18*c* can be smaller than the value when the aggregate 18*c* is contained. When the grain size of each of the MgO crystal particles 18*b* as a single particle is large, the grain sizes of the respective MgO crystal particles 18*b* are prone to have variations. However, by making the structure to have the aggregate 18*c*, the accumulation grain size distribution can be put within a predetermined range by controlling the level of aggregation of the aggregate 18*c* even when the grain sizes of the respective MgO crystal particles 18*b* are smaller than a predetermined grain size. Therefore, as shown in FIG. 4 for example, it is preferred to make the structure containing the aggregate 18*c* in which the MgO crystal particles 18*b* are aggregated. The above-mentioned condition to make the accumulation 10% value to be larger than or equal to 0.77 μm is applied to a value of an accumulation grain size distribution in the case of taking the aggregate 18*c* as one particle. Meanwhile, even when the aggregate 18*c* is contained, the sizes of the respective MgO crystal particles 18*b* may be a blocking factor in alignment of orientations as described above when the grain size of each of the MgO crystal particles 18*b* is excessively small. Therefore, it is preferred to make the amount of particles having a size smaller than two times the size of the head-vertex spacing W1 (smaller than 0.1 μm) shown in FIG. 5 to be as small as possible. As the present inventors have studied in this point of view, it has been revealed that, by making the accumulation grain size distribution for the single particles of the MgO crystal particles 18*b* included in the aggregate 18*c* to be 0.59 μm or larger at the accumulation 10% value, the MgO crystal particles 18*b* having grain sizes smaller than or equal to 0.1 μm are few, so that the orientations can be particularly easy to be aligned.

Here, the reason to define the accumulation grain size distribution of the MgO crystal particles 18*b* by the accumulation 10% value will be explained. As described above, the PDP 1 improves the discharge delay by aligning orientations of the surfaces opposing to the discharge space of the plurality of MgO crystal particles 18*b* by (100) plane. Further, each of the MgO crystal single particles 18*b*1 has a cubic form to align orientations. However, to align the orientations by (100) plane, it is important how the MgO crystal particles 18*b* having small grain sizes are eliminated as mentioned above.

Indexes for indicating the grain sizes of the MgO crystal particles 18*b* regarding the accumulation grain size distribution include an accumulation 50% value, accumulation 90% value, etc. In addition, there are a mode diameter (a range in which the existence percentage is the highest) of a frequency distribution, an average grain size, etc. However, in the case of the grain size distribution as shown in FIG. 6, the accumulation 50% value, the mode diameter, or the average grain size has a same value in the grain size distribution curve (a) and (b), while the amount of the MgO crystal particles 18*b* having small grain sizes required to be eliminated to align orientations is increased. On the other hand, by defining the accumulation grain size distribution of the MgO crystal particles 18*b* by the accumulation 10% value, the amount of the MgO crystal particles 18*b* having small grain sizes can be made to be a certain percentage or lower.

<2-3. Process of Forming Protective Layer>

A process of forming the protective layer 18 on the surface of the dielectric layer 17 shown in FIG. 1 and FIG. 2 includes: a step of preparing the MgO crystal particle 18*b*; a step of forming the MgO film 18*a* on the surface of the dielectric layer 17; and a step of attaching the plurality of MgO crystal particles 18*b* on the surface of the MgO film 18*a* so that the covering ratio of the MgO film 18*a* become lower than or equal to 10%. In the following detailed descriptions about the respective steps, a detailed description about the step of forming the MgO film 18*a* on the surface of the dielectric layer 17 will be omitted because the formation can be made by thin-film processes known in the present field such as electron beam evaporation and sputtering.

<2-3-1. Step of Preparing MgO Crystal Particles>

As a method of preparing MgO crystal particles to be attached on the surface of the MgO film 18*a*, a method of manufacturing by a vapor phase method is known. However, the MgO crystal particles 18*b* of the present embodiment are preferred to be prepared in the following method.

More specifically, MgO seed crystals obtained by a vapor phase method and a flux (fusing agent to accelerate fusion of the MgO seed crystal) are mixed and then baked, followed by grinding the obtained baked matter to prepare. The MgO seed crystals obtained by the vapor phase method have small grain sizes and large variations in grain size. In addition, it is difficult to make the MgO seed crystals to have a cubic form, so that minute particles of single MgO crystal are often attached on the MgO seed crystals even if the form was cubic. Accordingly, despite the MgO seed crystal itself is dispersed on the MgO film 18*a*, it is difficult to align orientations of the MgO seed crystals.

On the other hand, the MgO crystal particle 18*b* prepared by the above-described method have relatively (as compared with the MgO seed crystals) large grain sizes, and variations in grain size can be suppressed. Therefore, since it becomes easier to put the accumulation grain size distribution of the MgO crystal particles 18*b* within the above-mentioned predetermined range when the MgO crystal particles 18*b* are dispersed on the MgO film 18*a*, so that it becomes easier to align the orientations.

The preparation of MgO seed crystals by a vapor phase method can be carried out by, for example, those methods described in Japanese Patent Application Laid-Open Publication No. 2004-182521 and Nishida et al., "Preparation and Properties of Magnesia Powder by Vapor Phase Oxidation Process", Vol. 36, No. 410,November 1987,pp. 1157-1161, Journal of the Society of Materials Science, Japan. In addition, the MgO seed crystals manufactured by the vapor phase method may be purchased from Ube Material Industries, Ltd.

In addition, the flux is an accelerant which accelerates fusion of the MgO seed crystals, and for example, a halide of magnesium (e.g., magnesium fluoride) can be used. An adding amount of the flux may be, for example, 0.001 to 0.1 wt %.

Further, the baking of the mixture of the MgO seed crystals and the flux (fusing agent) is performed, for example, at 1000 to 1700° C. for 1 to 5 hours. Grain sizes of the obtained MgO crystal particles 18*b* become bigger in proportion to the baking temperature, baking time, or adding about of the flux. And, the smaller the grain size of the MgO seed crystal is, the faster the crystal growth in baking is. Therefore, variations in grain sizes of the MgO crystal particles 18*b* obtained in proportion to the baking temperature, baking time, and adding about of the flux become small. Accordingly, the baking temperature, baking time, and adding about of the flux are suitably set so that the accumulation grain size distribution of the MgO crystal particles 18*b* is put within the above-mentioned predetermined range. The MgO crystal particle 18*b* obtained by this method is prone to have a cubic form in particular. In addition, while the surface of the MgO seed crystal may have attached thereon the minute MgO crystal particles 30 as shown in FIG. 12, the minute MgO crystal particles 30 will be fused with the MgO seed crystals in such the method to fuse the MgO seed crystals as described above, so that the attachment of the minute MgO crystal particles 30 to the obtained MgO crystal particles 18*b* can be prevented or suppressed. Consequently, the MgO crystal particles 18*b* obtained by this method have a small amount of extremely small particles attached, and have a grain size of each single particle being bigger than the MgO seed crystals. In detail, by preparing the MgO crystal particles 18*b* by this method, an accumulation grain size distribution of the obtained MgO crystal single particle 18*b*1 is 0.59 μm or more at the accumulation 10% value.

The baked matter is obtained as a lump 18*d* in which a large number of the MgO crystal single particles 18*b*1 are aggregated, so the lump 18*d* is ground beforehand before being attached to the MgO film 18*a*. In addition, even in the case where the mixture with the flux is not made and baked, the MgO crystal particle 18*b* is prone to aggregate by absorbing moisture, so it is necessary to grind it. While the grinding method is not particularly limited as long as the shape of the MgO crystal particle 18*b* and the accumulation grain size distribution are within the range mentioned above, it is preferred to grind in the following method.

More specifically, as shown in FIG. 7 for example, the lump 18*d* such as the baked matter is dispersed in a solvent (dispersion medium) to form a first slurry 18*e*, and the first slurry 18*e* is ground by passing it through an orifice (restriction hole) 27 with pressurizing. When the lump 18*d* such as the baked matter is a very large one, the lump 18*d* is made into small lumps beforehand before dispersing the same in the solvent. The small lump is obtained by, for example, putting the baked matter in a mortar and grinding it down by the mortar. However, when the lump 18*d* is ground down to the predetermined accumulation grain size distribution mentioned above by the mortar, part of the cubical MgO crystal single particle 18*b*1 becomes prone to have a deficit. Therefore, at this stage, as a pretreatment in the grinding process described in the following, the lump 18*d* is ground to small lumps to the extent not to pose deficits in the cubic MgO crystal single particles 18*b*1.

Next, the first slurry 18*e* is formed by dispersing the lump 18*d* such as the baked matter in the solvent. While the dispersion medium (solvent) of the first slurry 18*a* is not particularly limited, it is preferred to be a compound having a molecular structure with a high polarity of such as hydroxyl group, carbonyl group, and nitride group, which does not disturb the crystal structure of the MgO crystal particle 18*b*, and alcohol such as 2-propanol (isopropyl alcohol: IPA) is particularly preferred. A concentration of the MgO crystal particles 18*b* in the slurry is set to, for example, 0.01 to 2 wt %. W1thin the concentration range, a second slurry 18*f* after grinding can be used (for example, continuously) as it is when using a spray method to disperse and distribute the MgO crystal particles 18*b* on the MgO film 18*a*.

Next, as the grinding process, the first slurry 18*e* in which the lump 18*d* is dispersed is sent towards a direction indicated by an arrow 28 in FIG. 7 by a solution sending pressure of a pump (high-pressure pump) P of a grinding apparatus to grind the lump 18*d* by passing the first slurry 18*e* through the orifice 27 with pressurizing. The lump 18*d* which is an aggregate of the MgO crystal single particles 18*b*1 in the first slurry 18*e* is ground by shearing force generated as being pressured and passed through the orifice 27, thereby obtaining the second slurry 18*f*. For the pump P, for example, a plunger pump can be used. In addition, a hole diameter and a hole shape of the orifice 27 can be changed according to the shearing force required to generate when passing the first slurry 18*e*. Note that, as an example of the grinding apparatus in FIG. 7, there is shown a method of splitting the flow path of the first slurry 18*e* into a plurality of flow paths (two in FIG. 7) and making the split paths into one before each of the paths is connected to the orifice 27. In this case, the lumps 18*d* contained in the first slurry 18*e* may be collided with each other upon flowing into the orifice 27, so that the lumps 18*d* are ground by the shock.

As such a grinding apparatus, a grain refinement apparatus "Nanomizer (Trademark)" of Yoshida Kikai Co., Ltd. can be used. According to this method, grinding is carried out without media for grinding down aggregates, so that it is possible to prevent foreign matter from being mixed in in the grinding process. In addition, by adjusting the number of cycles to pass the orifice 27 or the solution sending force, a level of aggregation (agglomeration degree) can be controlled. Further, since the load to be applied on the aggregates (shearing force) can be controlled, it is possible to prevent or suppress deficits of the cubic form of the MgO crystal single particle 18*b*1.

The accumulation grain size distribution of the MgO crystal particles 18*b* in the second slurry 18*f* after grinding is preferred to have its accumulation 10% value at 0.77 μm or larger. It aims to put the accumulation grain size distribution of the plurality of MgO crystal particles 18*b* obtained by the MgO crystal particles 18*b* attached to the MgO film 18*a* within the predetermined range described above.

Note that, while the above method is the most preferable in view of shape-retaining property of the cubic form of the MgO crystal single particle 18*b*1, there is a method using ball mill as another method to grind baked matter. In the case of grinding by using a ball mill, grinding can be done with using zirconia as a ball stone as an example. In this case, the agglomeration degree can be controlled by changing the amount of the ball stones and processing time. However, to grind by the ball mill, since it is a grinding method using media (ball stone), it is feared that not only aggregation of the secondary particles (i.e., lump 18*d*) is released, but also the primary particles may be damaged when grinding is performed too much. For example, it is feared that the cubic form may not be obtained as the MgO crystal particle 29 shown in FIG. 10. Note that, it is also same in the case where the grinding is done by the ball mill that the first slurry 18*e* is prepared to grind the lump 18*d* of the MgO crystal particles 18*b* contained in the first slurry 18*e*.

An accumulation grain size distribution in the case where the above first slurry 18*e* is processed by a ball mill or a grain refinement apparatus is shown in FIG. 8. The grain size distribution curves of (A), (B), and (C) are, (A): processed by ball mill, (B): grinding processing is done for three times by a grain refinement apparatus, and (C): grinding processing is done by a grain refinement apparatus. In the case of processing by a ball mill, the accumulation grain size distribution tends to be small compared with the case of processing by a grain refinement apparatus. In the case of (A), grinding is done to a level not containing the aggregate 18*c* (i.e., a state to be the MgO crystal single particles 18*b*1), and in the cases of (B) and (C), the aggregate 18*c* is contained. To compare these cases, the values of the accumulation grain size distributions are: an accumulation 10% value; an accumulation 50% value; and an accumulation 90% value in the order of (A), (B), and (C), where all of the values are high.

In addition, regarding the accumulation 10% value, while (A) indicates 0.60 μm, (B) indicates 0.77 μm, and (C) indicates 0.94 μm. That is, the result of (A) shows that the MgO seed crystal is not made into the MgO crystal particles 18*b* as it is in the present embodiment, and the accumulation grain size distribution of the MgO crystal single particles 18*b*1 can be made to be 0.59 μm or more for the accumulation 10% value by adding a flux and baking. Further, regarding the accumulation 90% value, while (A) indicates 1.68 μm, (B) indicates 2.93 μm and (C) indicates 3.84 μm. In other words, it is understood that the aggregate 18*c* is formed in the cases of (B) and (C) as at least a part of the MgO crystal single particles 18*b*1 is aggregated. Further, the results of (B) and (C) indicate that the aggregation state of the plurality of MgO crystal particles 18*b* is controlled by a method of grinding the lump 18*d* done by passing the first slurry 18*e* though the orifice 27 with pressurizing, so that the accumulation grain size distribution can be put within a predetermined range.

<2-3-2. Step of Attaching a Plurality of MgO Crystal Particles on Surface of MgO film>

A step of attaching the plurality of MgO crystal particles 18*b* on the surface of the MgO film 18*a* is not limited as long as it can disperse the MgO crystal particles 18*b* uniformly, and the spray method described below is particularly preferable in a point of being capable of dispersing the MgO crystal particles 18*b* uniformly.

In the spray method, a slurry (for example, the second slurry 18*f* after grinding described in <2-3-1>) in which the MgO crystal particle 18*b* is dispersed is discharged from a spray device called "spray gun" to attach the MgO crystal particles 18*b*. As the spray gun, a so-called two air atomizing system that atomizes the second slurry 18*f* and air in a two-liquid state can be used.

A concentration of the MgO crystal particle 18*b* in the slurry is 0.01 to 2 wt %. Also at this time, by adjusting the pressure of air (atomizing pressure) for atomizing the second slurry 18*f*, a size of a liquid drop of the atomized second slurry 18*f* can be adjusted, so that re-aggregation of the MgO crystal particle 18*b* in the liquid drop or defective attachment onto the MgO film 18*a* can be prevented. In addition, the MgO crystal particles 18*b* can be attached on the whole of the surface or a part on the MgO film 18*a*.

<3. Effect Verification Experiment>

Next, to verify effects of the respective configurations in the PDP 1 of the present embodiment described in the foregoing, results of experiments made by the present inventors will be described. FIG. 9 is an explanatory diagram showing the result of an effect verification experiment of the present embodiment.

In the effect verification experiment shown in FIG. 9, a PDP having an accumulation grain size distribution of the MgO crystal particle 18*b* in which an accumulation grain size 10% value is from 0.59 μm (sample 1) to 1.16 μm (sample 10) was manufactured, and discharge delays and non-uniformities of contrast (grained non-uniformity) in a screen during turning on are compared, so that effects obtained by the configuration having been described in the present embodiment was verified. Note that, "D10" in FIG. 9 indicates the accumulation 10% value in each sample and its unit is μm. In addition, "D50" and "D90" are the accumulation 50% value and 90% value in each sample, respectively, and their unit is μm. In the following, preparation conditions of the samples 1 to 10 and so forth will be described in the order of events.

<3-1. Preparation Condition of MgO Crystal Particles>

Preparation conditions of the MgO crystal particle 18*b* are as follows. First, 48 ppm of $MgF_2$ (manufactured by Furuuchi Chemical Corporation, Purity: 99.99%) as a flux was added to MgO seed crystal (manufactured by Ube Material Industries, Ltd., Product Name: High purity & Ultra fine single crystal magnesia (2000 A)). The MgO seed crystals added with the flux was mixed and crushed by grinding with pestle and mortar. Next, the above raw materials after mixture and crushing were subjected to baking in the atmosphere at a temperature of 1450° C. and for a baking time of 1 hour to obtain a baked matter of the MgO crystal particle 18*b*. Next, the obtained baked matter was ground with pestle and mortar.

A part of the obtained lump 18*d* was mixed in IPA (manufactured by Kanto Chemical Co., Inc., for electronic industrial use), and a grinding process was performed by the ball mill using zirconia as the ball stone until the aggregates 18*c* were disappear, so that a slurry having no aggregations (different from the second slurry 18*f* as it does not contain the aggregate 18*c*) is obtained. As for the sample 1 shown in FIG. 9, the slurry processed by the ball mill was dispersed to be distributed on the MgO film 18*a* to manufacture the PDP. Note that, the MgO crystal particle 29 shown in FIG. 10 shows an example of a sample ground by using the ball mill.

Further, after mixing another part of the obtained lump 18*d* in IPA, the second slurry 18*f* was obtained where its aggregation was controlled by changing the number of processing cycles with using a grain refinement apparatus (that is, the accumulation 10% value with respect to the state having no aggregation is controlled).

An accumulation grain size distribution for the MgO crystal particle 18*b* obtained here was figured out with using a grain size distribution meter of laser diffraction (Type: LA-300,manufactured by Horiba, Ltd.). Obtained results are listed in FIG. 9.

<3-2. Conditions of Dispersion and Distribution Onto MgO Film>

Next, the second slurry 18*f* whose aggregations were controlled was sprayed to be applied on the MgO film 18*a* with using a spray gun for application to attach the MgO crystal particles 18*b* onto a surface of the MgO film 18*a*. The spray gun used here is two-liquid air atomizing system. A concentration of the MgO crystal particles 18*b* in the second slurry 18*f* was set to 0.6 wt %, and an atomizing pressure applied on the spray gun was set to 180 kPa. The MgO crystal particles 18*b* were attached to obtain a density of 0.1 g per 1 $m^2$.

<3-3. Other Manufacturing Conditions of PDP>

Other manufacturing conditions of the PDP of the samples 1 to 10 shown in FIG. 9 are as follows, respectively. As shown in FIG. 1, the front plate structure 11 was manufactured by forming the display electrode pair (X electrode 14 and Y electrode 15), the dielectric layer 17, and the protective layer 18 (the MgO film 18*a* and the plurality of MgO crystal particles 18*b* whose orientations are aligned attached on the MgO film 18*a*) on the front plate 13 formed of glass. In addition, the address electrode 20, the dielectric layer 21, the barrier ribs 22, and the phosphors 23 were formed on the rear plate 19 formed of glass, so that the rear plate structure 12 was manufactured. Next, the front plate structure 11 and the rear plate structure 12 were overlapped to have their outer rim sealed by a sealant, thereby manufacturing a panel having gastight discharge spaces inside. Next, after exhausting the inside of the discharge spaces 24, a discharge gas is filled to complete the PDP.

Conditions for respective plate structures are as follows.

(Front Plate Structure 11)

Widths of the X, Y transparent electrodes 14*a* and 15*a*: 270 μm;

Widths of the X, Y bus electrodes 14*b* and 15*b*: 95 μm;

Width of the discharge gap: 100 μm;

The dielectric layer 17: Formed by applying a low melting point glass paste and baking, Thickness: 30 μm; and The MgO film 18*a*: An MgO film formed by electron beam evaporation, Thickness: 1.1 μm.

(Rear Plate Structure 12)

Width of the address electrode 20: 70 μm;

The dielectric layer 21: Formed by applying a low melting point glass paste and baking, Thickness: 10 μm;

Thickness of each of the phosphors 23 just above the address electrode 20: 20 μm;

Height of the barrier rib 22: 140 μm, Width at the top portion: 50 μm;

Pitch of the barrier ribs 22: 360 μm; and

Discharge gas: Ne 96%-Xe 4%, 500 Torr.

<3-4. Lighting Test and Evaluation>

Next, a lighting test was performed on the each manufactured PDP to evaluate the covering ratio of the MgO film 18*a*, existence of red chromatic non-uniformity, discharge voltage, discharge delay, and X-ray diffraction signal intensity measurement. Results of the lighting test are shown in FIG. 9 together.

First, evaluations of the covering ratio, existence of red chromatic non-uniformity, and discharge voltage will be explained. In a measurement of the covering ratio, ten measurement points were measured as dividing the viewing range, and the covering ratio of the MgO film 18*a* was 10% or lower at every measurement point for the samples 1 to 10. In addition, each PDP was subjected to a so-called aging process for 8 hours and the red chromatic non-uniformity was visually checked, but the red chromatic non-uniformity was not found in all the samples 1 to 10. In the case where the phosphor 23 is degraded due to impure substances, the red chromatic non-uniformity will be apparent when performing the 8-hour aging process. Accordingly, it is considered that the samples 1 to 10 shown in FIG. 9 were prevented from apparent red chromatic non-uniformity by making the covering ratio of the MgO film 18*a* to be 10% or lower. In addition, although not shown in FIG. 9, a PDP in which the MgO crystal particles 18*b* are not attached onto the surface of the MgO film 18*a* was manufactured and discharge voltages of this PDP and respective PDPs of the samples 1 to 10 were measured, and an increase in discharge voltage was not confirmed in them also. Consequently, it is conceivable that the samples 1 to 10 shown in FIG. 9 were prevented from an increase of discharge voltage by making the covering ratio of the MgO film 18*a* to be 10% or lower.

Next, evaluation results of discharge delays will be explained. In a discharge delay test, a voltage was applied on the address electrode 20, and a time period from the voltage application to actually starting discharge was measured. The time period to start a discharge was measured for 1000 times, where the 1000 measurement data were evaluated about the time period to start 95% or more of discharge (value of accumulation discharge success probability 95%) in the evaluation method. To determine whether the discharge delay is improved or not, samples having a value to be the accumulation discharge success probability 95% being shorter than 1.1 μsec were marked with a circle, and samples having a value to be the accumulation discharge success probability 95% being longer than or equal to 1.1 μsec were marked with a cross, respectively. A reason of setting the threshold for determining the improvement effect of the discharge delay at 1.1 μesc is as follows. That is, the threshold was determined in consideration of making the PDP 1 compliant with the standard of full high definition television. To explain in more detail, in the PDP 1 compliant with the full high definition television standard, when one field (16.7 seconds) is divided into 10 subfields to drive by the progressive system, time per one subfield is about 1.7 second. Since 1080 scanning cycles of address discharge are made within the time, the discharge delay in the address discharge is necessary to be shorter than 1.6 μsec (1.7 msec/1080 cycles) at least. In addition, since it is necessary to perform a sustain discharge and an initializing discharge (also so-called reset discharge) in one subfield, the threshold was set to 1.1 μsec in consideration of time required for these discharges.

In FIG. 9, the improvement effect of discharge delay was not confirmed in the samples 1 and 2 having the accumulation 10% value of the MgO crystal particle 18*b* at 0.69 μm or lower. On the other hand, the discharge delay was improved in each of the samples 3 to 10 having the accumulation 10% value of the MgO crystal particle 18*b* at 0.77 μm or larger. Shapes of the MgO crystal particles used for each sample were mostly in a cubic form like, for example, the MgO crystal particle 18*b* shown in FIG. 5 for the samples 3 to 10. On the other hand, for the samples 1 and 2, there were more MgO crystal particles having a part of the cubic defected like, for example, the MgO crystal particle 29 shown in FIG. 10 than the samples 3 to 10, and particularly, the sample 1 had many MgO crystal particles having a part the cubic defected.

As a result of performing X-ray diffraction signal intensity measurements on respective samples and the above-described standardization, X-ray diffraction signal intensities of the sample 1 and sample 2 were both smaller than an X-ray diffraction signal intensity of (111) plane per a thickness 1 μm of the MgO film 18*a*. On the other hand, X-ray diffraction signal intensities of all of the samples 3 to 10 were equal to or larger than the X-ray diffraction signal intensity of (111) plane per a thickness 1 μm of the MgO film 18*a*. More specifically, regarding the samples 1 and 2, it is considered that the orientations of surfaces opposing to the discharge space 24 were not aligned by (100) plane due to excessively performing grinding so that the cubic form is destroyed. On the other hand, regarding the samples 3 to 10, damages on the primary particles (i.e., the MgO crystal single particle 18*b*1) can be suppressed to the minimum by adjusting the level of grinding, so that the orientations of surfaces opposing to the discharge space 24 can be aligned by (100) plane as a result.

According to the results, it has been revealed that the orientations of the respective MgO crystal particles 18*b* can be aligned by (100) plane by making the shape of the MgO crystal particle 18*b* to be a cubic form, thereby improving the discharge delay as a result. In addition, it has been revealed that the orientations become easier to align by controlling the aggregation state to make the accumulation 10% value of the MgO crystal particle 18*b* to be 0.77 μm or more, thereby improving the discharge delay as a result. It is expected that the shape retaining property of the cubic form of each of the MgO crystal single particle 18*b*1 was improved because the damage applied on the primary particles (the MgO crystal single particle 18*b*1) in grinding was able to suppress to the minimum by controlling the aggregation state to make the accumulation 10% value at 0.77 μm or more. Further, the level of aligning the orientations can be determined by measuring the X-ray diffraction signal intensity. It has been revealed that the discharge delay can be improved when a value of {signal intensity of (200) plane/signal intensity of (111) plane} after the standardization is same magnitude or more.

In addition, the MgO crystal single particles 18*b*1 shown for the sample 1 containing the aggregates 18*c* were used for the samples 2 to 10, respectively, in which the respective levels of aggregation were changed. Therefore, when assuming that the each accumulation grain size distribution of the MgO crystal single particle 18*b*1 contained in the aggregation 18*c* in the samples 2 to 10 is at 0.59 μm or more at the accumulation 10% value, it has been experimentally verified that the discharge delay can be improved by controlling the level of aggregation so as to make the accumulation 10% value of the MgO crystal particle 18*b* containing the aggregation 18*c* to be 0.77 μm or more.

Further, in the configuration containing the aggregation 18*c*, it has been revealed that, when the accumulation grain size distribution for a single particle of the MgO crystal single particle 18*b*1 forming the aggregation 18*c* is further smaller than that, i.e., the accumulation 10% value is at 0.59 μm or more, the discharge delay can be improved because the orientations of the surfaces opposing to the discharge space 24 can be aligned by (100) plane.

Further, according to the present embodiment, the accumulation grain size of the MgO crystal particle 18*b* can be put within the predetermined range without adding a new process for, for example, classifying the MgO crystal particle 18*b*, thereby suppressing lowering of manufacture efficiency. Note that, while the process of grinding the lump 18*d* in the first slurry is included in the present embodiment, the manufacturing processes will not be increased even when the present grinding process is carried out because the MgO single crystal has a high aggregation property and so it is necessary to grind aggregations in any way even in the case described above where the MgO seed crystal is used as the MgO crystal particle as it is.

In the foregoing, the invention made by the inventors of the present invention has been concretely described based on the embodiments. However, it is needless to say that the present invention is not limited to the foregoing embodiments and various modifications and alterations can be made within the scope of the present invention.

The present invention is widely applicable to a plasma display panel used for a plasma display apparatus to be used as, for example, a display apparatus for such as a personal computer and a work station, a flat-screen television set, or an apparatus for displaying advertise, information etc.

What is claimed is:

1. A plasma display panel comprising a pair of plate structures opposing to each other interposing a discharge space formed with filling a discharge gas, and one of the pair of plate structures includes a plurality of display electrode pairs arranged on a plate, a dielectric layer covering the plurality of discharge electrode pairs, and a protective layer covering the dielectric layer, wherein the protective layer includes an MgO (magnesium oxide) film stacked on a surface of the dielectric layer, and a plurality of MgO crystal particles spread out on the MgO film in a region corresponding to all cells of the plasma display; a covering ratio of the plurality of MgO crystal particles on a surface of the MgO film in the region corresponding to all cells is 10% or lower; an accumulation 10% value in an accumulation grain size distribution of the plurality of MgO crystal particles is made to be 0.77 μm or larger to 1.16 μm or smaller, an MgO crystal single particle forming the MgO crystal particles has a cubic form; and a standardized value of (200) plane is larger than or the same as the value of (111) plane according to an X-ray diffraction signal intensity measurement on (200) plane per 1 μm thickness of the MgO film.

2. The plasma display panel according to claim 1, wherein the plurality of MgO crystal particles are arranged to make orientations of surfaces opposing to the discharge space are aligned by (100) plane.

3. The plasma display panel. according to claim 1, wherein the MgO film has an orientation of (111) plane in a surface opposing to the discharge space.

4. The plasma display panel according to claim 1, wherein the MgO crystal particles contain an aggregate in which a plurality of the MgO crystal single particles are arranged.

5. The plasma display panel according to claim 1, wherein the MgO crystal particles are devoid of particles having a grain size smaller than or equal to 0.1 μm.

6. The plasma display panel according to claim 1, wherein the MgO crystal particles contain an aggregate of MgO crystal single particles having a cubic form.

* * * * *